US005256232A

United States Patent [19]

Fuss et al.

[11] Patent Number: 5,256,232

[45] Date of Patent: Oct. 26, 1993

[54] APPARATUS AND METHOD FOR WINDING STRIPS OF WEB MATERIAL ONTO SPOOLS

[75] Inventors: Fred M. Fuss, Hamlin; David E. Wenschhof, Victor, both of N.Y.

[73] Assignee: Eastman Kodak Company, Rochester, N.Y.

[21] Appl. No.: 920,400

[22] Filed: Jul. 27, 1992

[51] Int. Cl.[5] ..... B31C 1/00; B32B 31/00; B65H 21/00; B65H 27/00

[52] U.S. Cl. ..... 156/187; 156/184; 156/360; 156/361; 156/446; 156/519; 242/56 R; 242/67.1 R; 242/75.5

[58] Field of Search ..... 156/184, 187, 446, 519, 156/521, 361, 360; 242/56 R, 58, 67.1 R, 75.5, 75.52

[56] References Cited

U.S. PATENT DOCUMENTS

| | | | |
|---|---|---|---|
| 3,030,042 | 4/1962 | De Gelleke | 242/66 |
| 3,532,573 | 10/1970 | Herman | 156/295 X |
| 3,670,980 | 6/1972 | Mukai et al. | 242/67.1 |
| 4,324,607 | 4/1982 | Dugger | 156/446 X |
| 4,351,687 | 9/1982 | Lesage | 156/353 X |
| 4,371,410 | 2/1983 | Stevens | 156/117 X |
| 4,422,588 | 12/1983 | Nowisch | 242/56.3 X |
| 4,736,567 | 4/1988 | Pierra | 53/157 X |
| 5,030,311 | 7/1991 | Michal | 156/256 X |
| 5,049,222 | 9/1991 | Irie | 156/159 X |
| 5,096,134 | 3/1992 | Sakano | 242/58 X |
| 5,102,490 | 4/1992 | Becker | 156/406.4 X |

*Primary Examiner*—David A. Simmons
*Assistant Examiner*—Charles Rainwater
*Attorney, Agent, or Firm*—Charles E. Snee, III

[57] ABSTRACT

Apparatus for winding web material (14) comprises a reciprocating carriage assembly (22) which delivers the leading end of the web to a winding spindle (30) and then moves away from the spindle as winding proceeds. A builder roll (138) mounted on the carriage assembly applies pressure during winding. A tape tab (178) is automatically applied to the trailing end of the web and pressed onto the completed roll (140) by the builder roll, while a stepping motor (176) for the builder roll resists the winding motor to maintain tension in the final convolution of the web. A corresponding method is taught.

17 Claims, 16 Drawing Sheets

APPARATUS AND METHOD FOR WINDING STRIPS OF WEB MATERIAL ONTO SPOOLS

TECHNICAL FIELD

The invention concerns apparatus and methods for winding strips of web material onto spools. More particularly, the invention is related to such apparatus and methods in which the trailing end of the web material is secured to the outermost convolution while tension is maintained on the web material, to prevent loosening of the completed roll.

BACKGROUND ART

Various types of web materials, including photographic film, have long been wound into rather large reels or rolls for shipment or sale. To prevent the web materials from loosening or clock-springing on the rolls, a common practice has been to tape the trailing end of the web material to the outermost convolution. In the case of photographic films, large diameter rolls of film may be shipped over long distances, the rolls being placed flat in stacks. If the outer convolutions of the film are not held tightly in place during such movement, they will tend to move vertically due to vibrations generated during transport, which can lead to abrasion marks on successive convolutions of the film. Similar difficulties can be experienced with other types of web material.

When a roll of web material is being wound under tension, the last convolution needs to be held at that tension while the web material is cut and its trailing end is attached to the roll, typically with a tab of tape. If the web material is allowed to go slack, the outer convolutions rather quickly will clock-spring loose, after which it is nearly impossible to pull the web material back to the wound-in tension. Commonly, the cutting and taping of the end of the web material, such as photographic film, is a manual operation. After the winding apparatus has stopped, the operator must hold the trailing portion of the web material very tightly against the roll with one hand while the web material is cut and then apply a precut tab of tape to the trailing end of the web material with the other hand. This is a difficult task to accomplish and even a slight relaxation of the tension on the roll can lead to later abrasion problems of the type just mentioned. Thus, a need has existed for an apparatus and method for securing the trailing end of such web materials without losing tension in the web.

SUMMARY OF THE INVENTION

The apparatus of the invention is particularly suited for winding web material such as photographic film onto a spool and comprises a source of web material to be wound; a first frame; means mounted on the first frame for rotating the spool about an axis to wind the web material onto the spool; a second frame; means mounted on the first frame for permitting the second frame to move toward or away from the axis; means mounted on the second frame for guiding a leading end of the web material toward the spool; roll means mounted on the second frame for engaging an outermost convolution of the web material during winding onto the spool; means mounted on the first frame for moving the second frame on the means for permitting toward the axis to facilitate attachment of the leading end to the spool and then away from the axis to allow continued winding of the web material onto the spool;

means for pressing the roll means against the outermost convolution; and means for applying a tab of adhesive tape to a trailing end of the web material before the trailing end passes the roll means, the tab of adhesive tape having an adhesive portion extended beyond the trailing end, whereby the adhesive portion of the tab of adhesive tape is rolled by the roll means onto an underlying convolution of the web material to secure the trailing end.

The apparatus of the invention may also comprise means mounted on the second frame for permitting the roll means to move away from the axis; means for detecting the position of the roll means relative to the second frame as the web material is wound onto the spool; and means responsive to the means for detecting for actuating the means for moving to move the second frame away from the axis as the web material is wound. Motor means may be provided for controllably rotating the roll means in contact with the outermost convolution and the tab of adhesive tape as the spool is rotated, in order to maintain tension in the web material as the tab of adhesive tape is applied to the underlying convolution. Pinch roll means may be mounted on the second frame for driving the web material through said means for guiding. The pinch roll means may comprise a first, idler roll; a second, pinch roll; means for controllably rotating the pinch roll; and means for moving the pinch roll into or out of contact with the web material opposite the idler roll. When the web material comprises a series of strips of web material joined end to end by splices, the apparatus may include means for cutting the web material downstream of each of the splices before each of the splices reaches the means for applying, thereby defining the trailing end for a leading strip of the web material and thereafter for cutting the web material upstream of each of the splices, thereby defining the leading end for a following strip of the web material; means for deflecting each of said splices from the means for guiding; and means for conveying each of the splices away from the means for guiding after the splices have been cut from the web material. The means for applying may comprise a source of adhesive tape, the tape having a leading end; means for cutting the adhesive tape into tabs; means for grasping the leading end of the adhesive tape and advancing the leading end to the means for cutting; means for acquiring and moving each of the tabs of adhesive tape to a position opposite the trailing end and adjacent the means for guiding; and means for moving the trailing end and one of the tabs of adhesive tape into engagement. The means for guiding may comprise a pair of spaced, elongated guide tracks each having a groove for receiving an edge of the web material; and the means for moving the trailing end may press against the trailing end to bow the trailing end into contact with the tabs of adhesive tape on the means for acquiring and moving.

The method of the invention comprises the steps of rotating a spool about an axis to wind a web material onto the spool; engaging an outermost convolution of the web material with a roll during winding onto the spool; pressing the roll against the outermost convolution as a trailing end of the web material nears the spool; stopping the spool while maintaining torque thereon; applying torque to the roll to maintain tension on the outermost convolution; applying a tab of adhesive tape to the trailing end before the trailing end passes the roll, the tab of adhesive tape having an adhesive portion extended beyond the trailing end; and rotating the spool and the roller to maintain tension in the web material, whereby the adhesive portion of the strip of adhesive tape is applied by the roller to an underlying convolution of the web material to secure the trailing end and to maintain tension in the web material.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
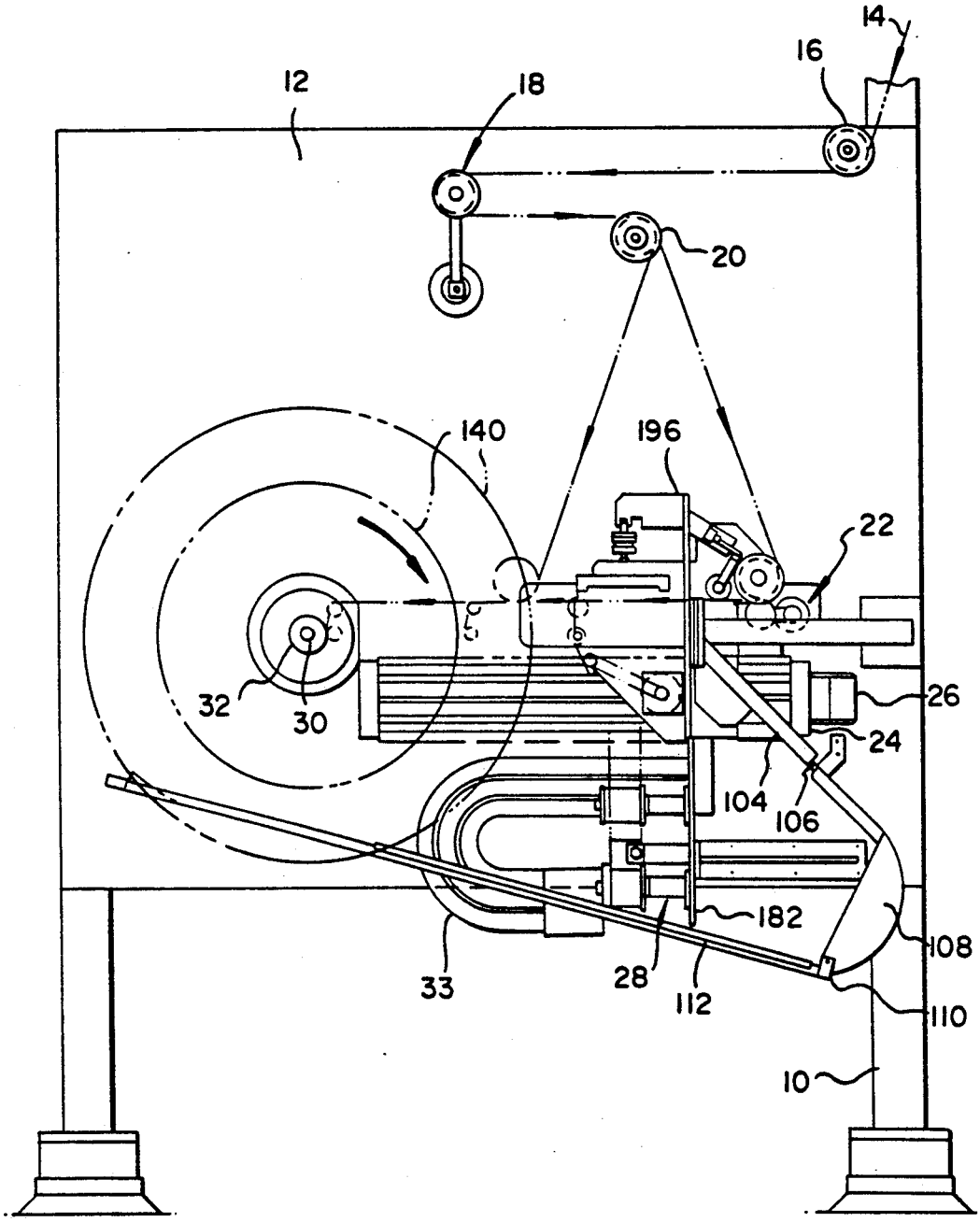
FIG. 1 shows a front elevation view of the apparatus of the invention.

The following is a detailed description of the preferred embodiments of the invention, reference being made to the drawings in which the same reference numerals identify the same elements of structure in each of the several Figures.

Overall Structure and Operation

FIG. 1 shows a front elevation view of the apparatus of the invention. A rigid frame 10 supports a preferably vertically oriented rigid face plate 12. A length of web material 14, which may be one long strip or a series of strips joined by splices, is brought to the apparatus from a source not illustrated, wrapped around an idler roller 16 and then wrapped around the roller of a dancer assembly 18 which maintains the tension on web 14 within a desired range. From dancer assembly 18, web 14 passes about another idler roller 20 and then is threaded through a carriage assembly 22 which is supported in front of face plate 12 by a conventional ball slide assembly 24 driven by a stepping motor 26. Carnage assembly 22 can be moved back and forth behind a tape tab feed and cut assembly 28 which extends outward from face plate 12. Web 14 is driven toward a winding spindle 30 on which a spool or core 32 is mounted for winding a large roll of web 14, as indicated in phantom. The position of dancer assembly 18 also is monitored by conventional means not illustrated to provide a signal for control of the speed of winding spindle 30. Electrical, pneumatic and vacuum services are provided to carriage assembly 22 through a flexible cable carrier 33.

In operation, carriage assembly 22 first moves close to core 32 to facilitate attachment of the leading end of web 14 to the core, either manually or by any conventional means. As winding proceeds, carriage assembly 22 is moved away from the core while a builder roll mounted on carriage assembly 22, to be discussed subsequently, maintains a desired pressure on the outer convolution of the growing roll of web material. When the roll has nearly reached the desired size, spindle 30 and carriage assembly 22 are stopped and the trailing portion of the web material is held tightly against the roll by the builder roll, to prevent loss of tension. A cutoff knife assembly on carriage assembly 22 is then actuated to cut the web material. Spindle 30 then rotates the roll slightly to advance the trailing end of the web material to a position where a strip or tab of tape is applied, while a controlled torque is applied to the builder roll to maintain tension in the roll. The tab of tape is then drawn under the builder roll which rolls the tab onto the completed roll, all without releasing tension on the web material. The carriage assembly then withdraws to permit removal of the completed roll and the process repeats.

Carriage Assembly

Figure 2:
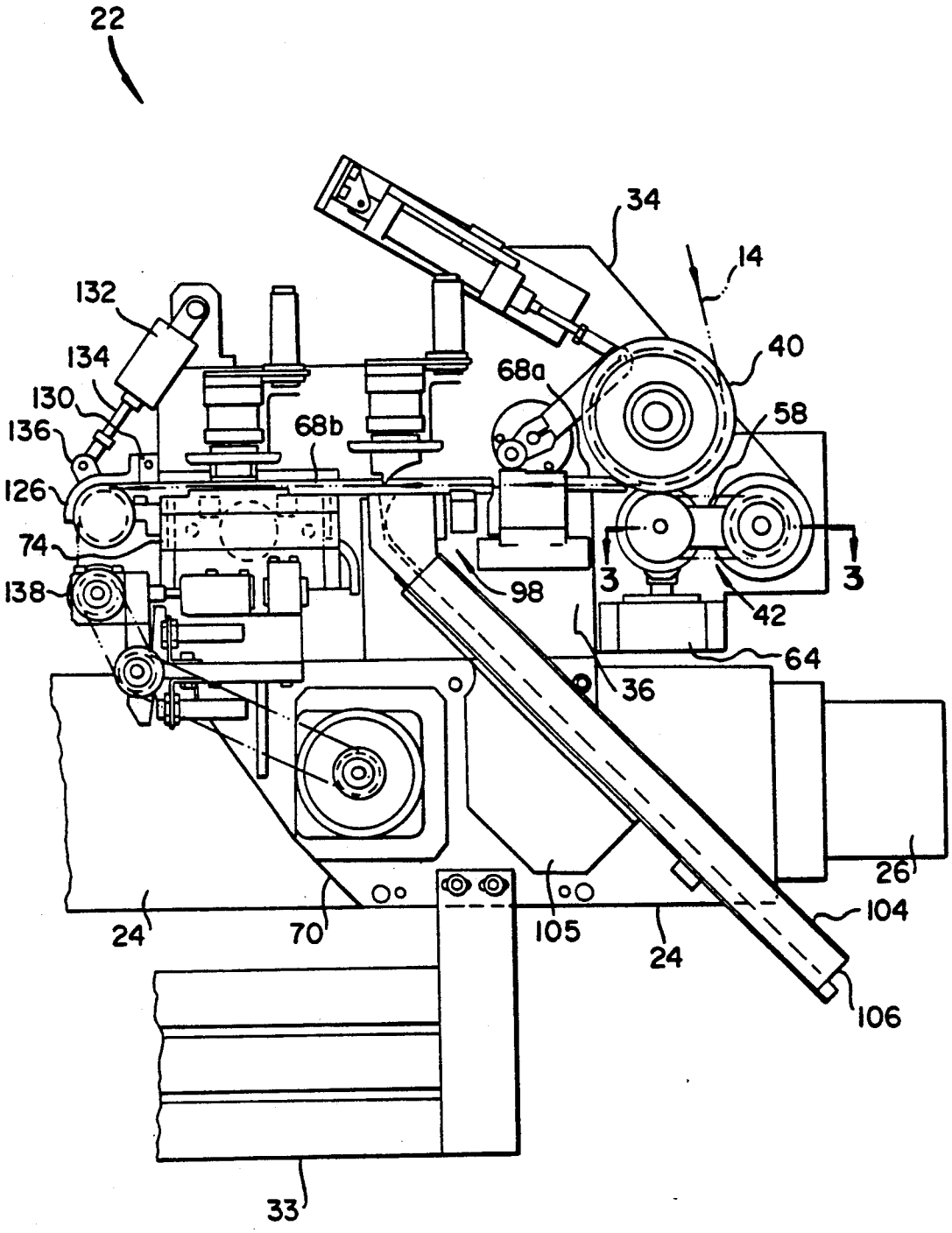
FIG. 2 shows an enlarged front elevation view of the carriage assembly.
Figure 3:
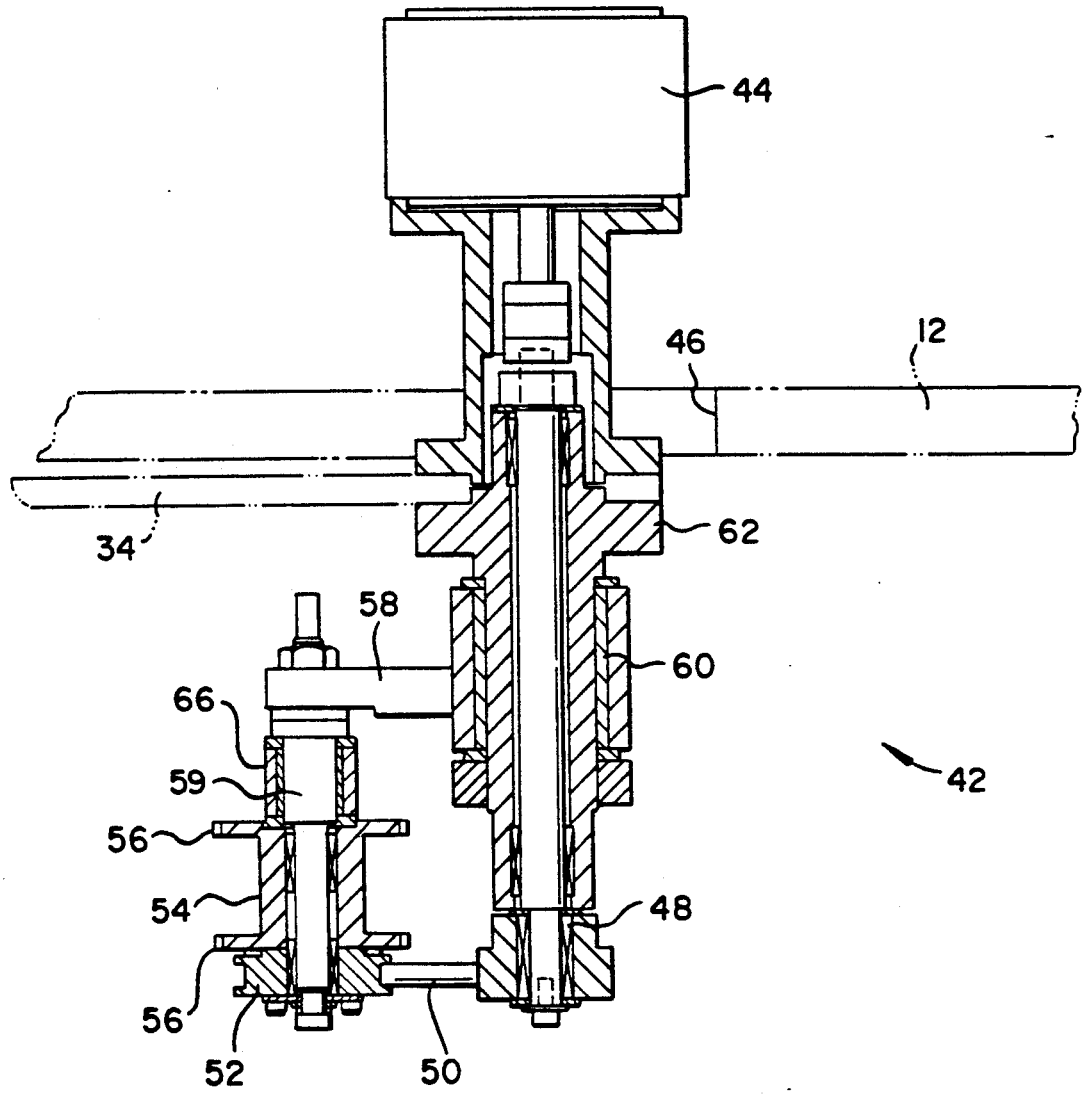
FIG. 3 shows a plan view, partially in section of the pinch roll assembly, taken along line 3—3 of FIG. 2.

As shown in FIGS. 2 to 9, carriage assembly 22 comprises a frame having a back plate 34 of irregular polygonal shape, a center plate 36 and standoff plates 38 which position plate 36 parallel to plate 34. At the right end of carriage assembly 22 as viewed in FIG. 2, web 14 is passed around an idler roll 40 rotatably mounted on back plate 34 and into a pinch roll assembly 42. As shown in FIG. 3, a stepping motor 44 is mounted on the back side of back plate 34 and extends rearwardly of the apparatus through a hole 46 provided in face plate 12. At the forward end of its output shaft, stepping motor 44 supports a timing pulley with a one way clutch 48, which drives a timing belt 50 extending to a timing pulley 52 mounted on one end of a pinch roll 54. When web material 14 is photographic film, pinch roll 54 preferably comprises end flanges with narrow polyurethane tires 56 which will engage only the edge portions of the film. A pivot arm 58 is mounted for pivoting movement on a bushing 60 supported by the housing 62 for the output shaft of stepping motor 44. At its outer end, pivot an-n 58 supports one end of the shaft 59 on which pinch roll 54 is mounted for rotation. Beneath pinch roll 54, as seen in FIG. 2, an air cylinder 64 is mounted on back plate 34, the rod end 66 of the cylinder rotatably supporting shaft 59; so that, extension of the rod causes pinch roller 54 to move into contact with idler roll 40. Thus, stepping motor 44 can be actuated to drive web 14 through carriage assembly 22. When pinch roll assembly 42 is rotated, stepping motor 44 is run at a speed to match the speed of web 14 as sensed by dancer assembly 18.

Immediately downstream of pinch roll assembly 42, web 14 is threaded between a pair of elongated, segmented guide tracks 68*a*, 68*b* each having a groove for receiving an edge of web 14 to guide the web toward spindle 30 and core 32, as seen best in FIGS. 2 and 6 to 8, while leaving the upper and lower surfaces of the web accessible from above and below. Guide tracks 68*a* are supported by center plate 36 and a bracket 67. Guide tracks 68*b* are supported by center plate 36 and a bracket 65 and by a tape tab applicator assembly 74, shown in FIGS. 17 to 19, which supports the downstream end of guide tracks 68*b* by means of brackets 69 and 127.

Figure 5:
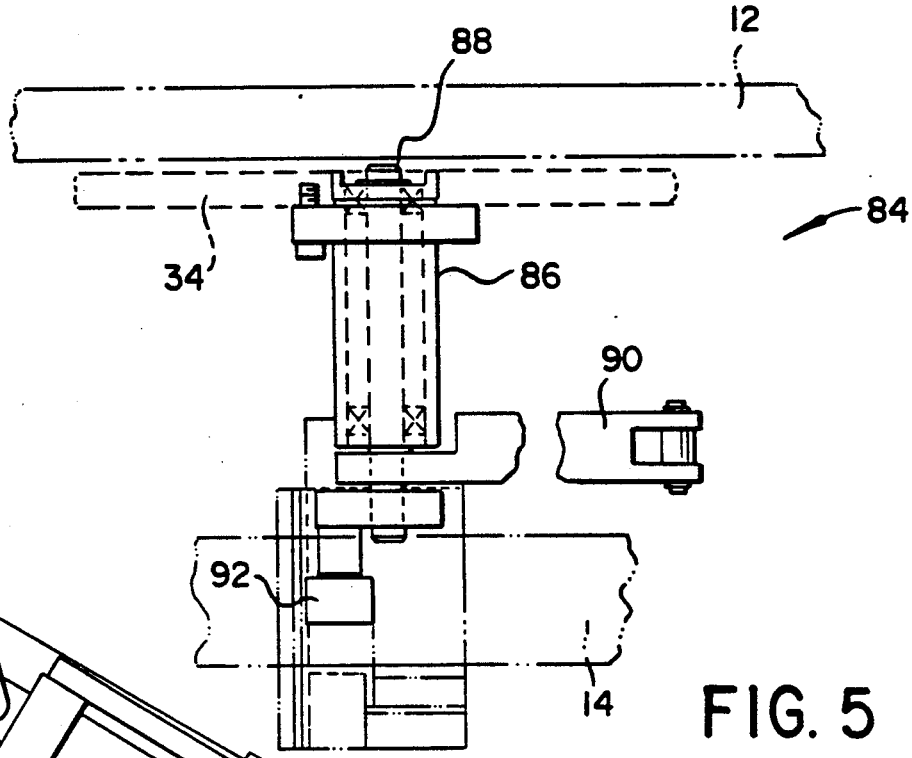
FIG. 5 shows a top view of the assembly of FIG. 4.
Figure 4:
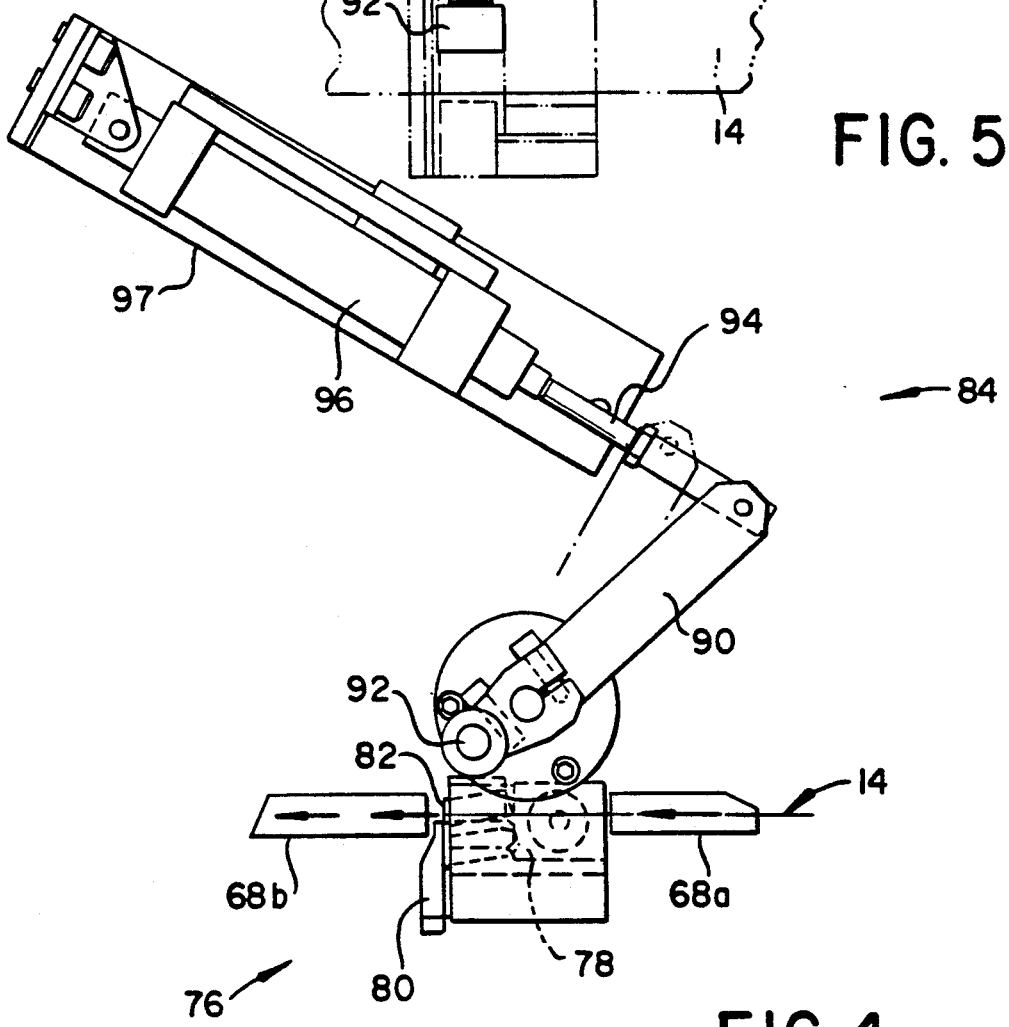
FIG. 4 shows an enlarged front elevation view of the web cutoff knife assembly.

As shown in FIGS. 4 and 5, guide tracks 68*a* lead web 14 into the throat of a web cutoff knife assembly 76 comprising a conventional swing knife 78 and a fixed blade 80 between which the web passes. An actuator mechanism 84 for knife assembly 76 comprises a housing 86 mounted to back plate 34 within which a shaft 88 is mounted for rotation. A crank arm 90 fixed on the forward end of shaft 88 supports an actuator roller 92 which bears (in moving blade 82. The opposite end of crank arm 90 is pivotably attached to file rod 94 of an air cylinder 96 mounted by a bracket 97 to back plate 34. Thus, actuation of cylinder 96 causes moving blade 82 to descend from the solid fine position to the dashed line position of FIG. 14, thereby cutting web 14.

Figure 6:
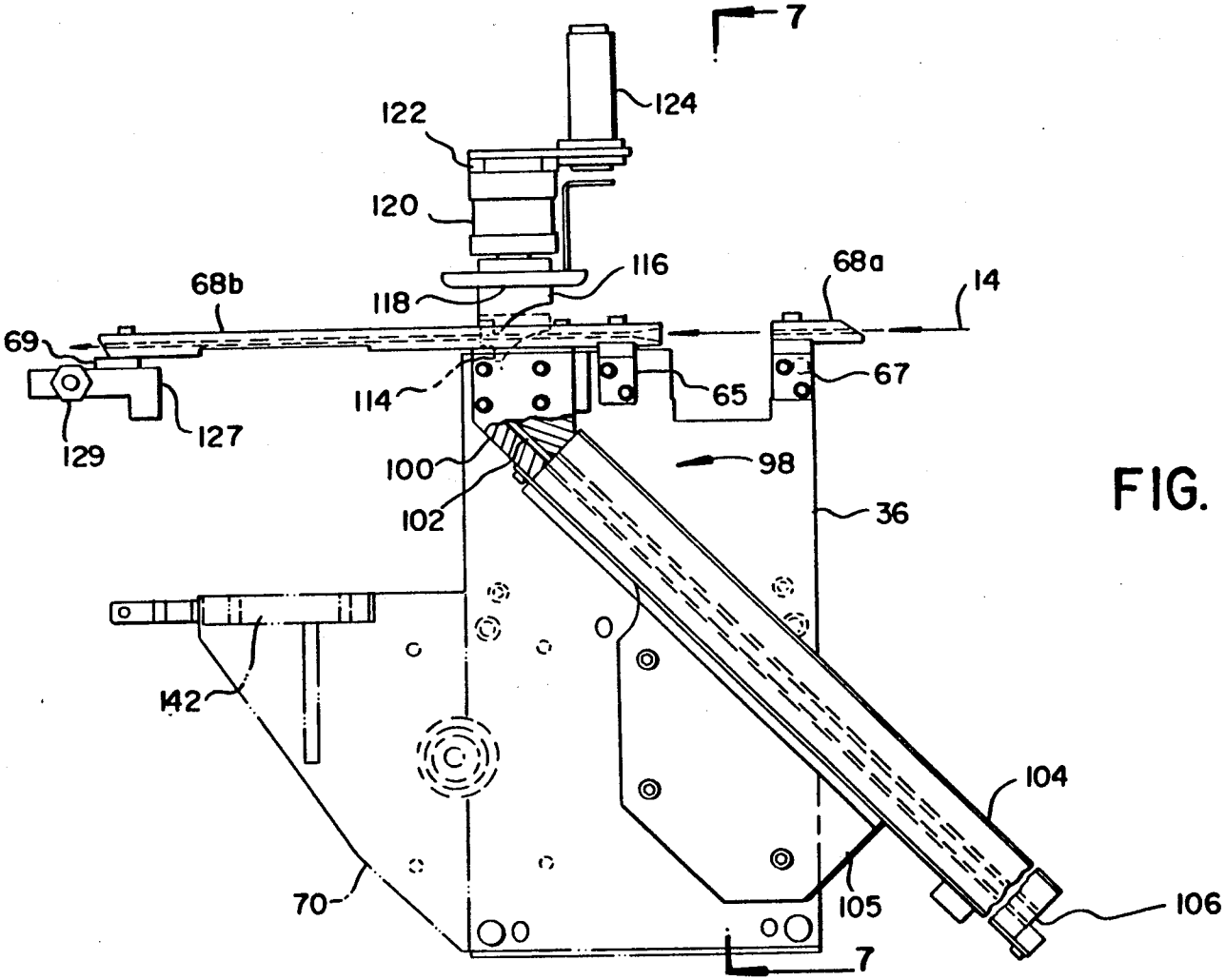
FIG. 6 shows an enlarged front elevation view of the splice removal assembly.
Figure 7:
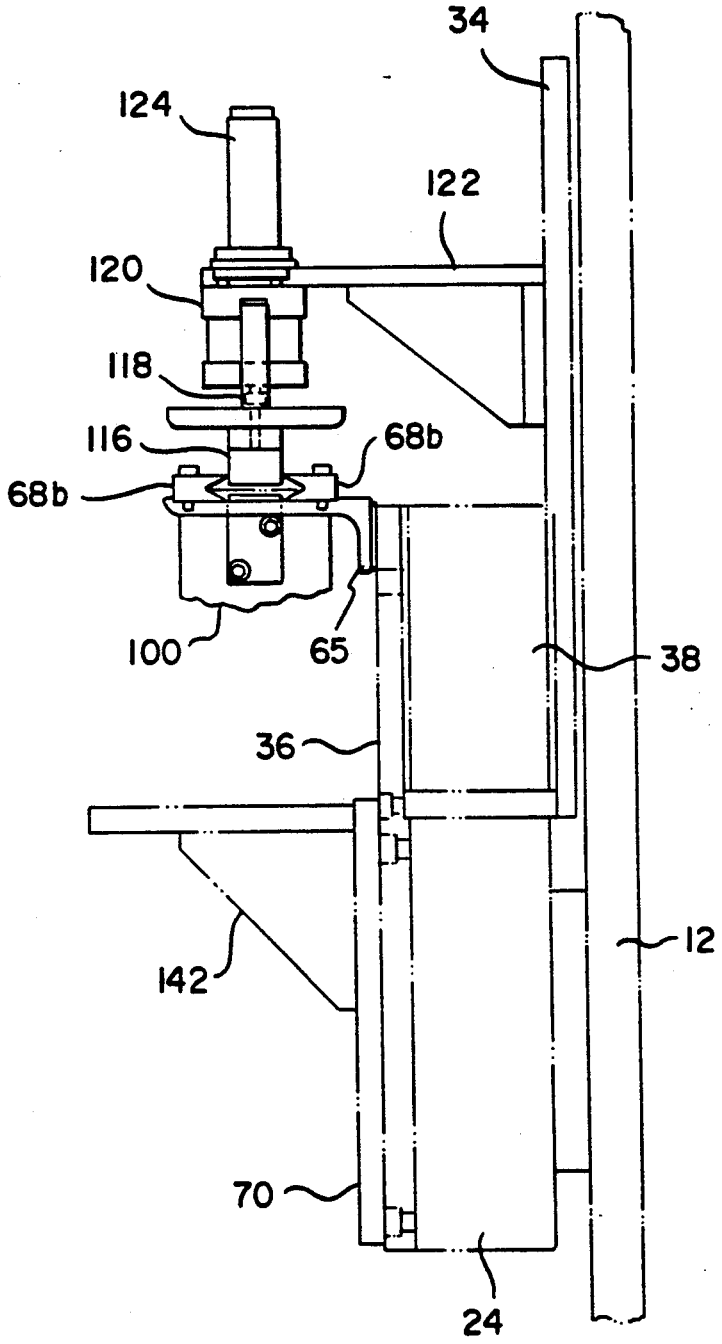
FIG. 7 shows a side elevation view, partially broken away, taken along line 7—7 of FIG. 6.

If web 14 comprises a series of strips of web material joined by splices, the web can be cut just downstream of each splice to form a trailing end of the web which is then taped to the completed roll in a manner to be described subsequently. To remove the splice from the web, a web diverter assembly 98 may be provided as shown in FIGS. 6 and 7, which comprises a web guide block 100 positioned below the path of the web following a segment of guide tracks 68*b*. Block 100 includes a downwardly curved interior channel or slot 102 to guide the lead end of a splice away from guide tracks 68*b* into a translating air track or pneumatic conveyor section 104 mounted by a bracket 105 on center plate 36 with a front plate 70 in between. The outlet end 106 of air track 104 is aligned with the inlet end of a curved diverter track section 108 when carriage assembly 22 is fully retracted. The outlet end 110 of track section 108 is connected to the inlet end of a fixed track section 1 12, both track sections 108 and 1 12 being supported by face plate 12. The throat 114 of slot 102 opens upwardly beneath web 14 opposite a web diverter block 116 of matching shape, which is supported by the rod 118 of an air cylinder 120 mounted on a bracket 122 extended outward from back plate 34. A position sensor 124 may be provided to monitor the location of diverter block 116. After the web has been cut at the downstream end of a splice, pinch roll assembly 42 is actuated to drive the splice through cutoff knife assembly 76. Simultaneously, cylinder 120 is actuated to lower diverter block 116 into throat 114; so that, the leading end of the splice enters channel 102. When the trailing end of the splice reaches the throat of cutoff knife assembly 76, pinch roll assembly 42 is stopped and the web is cut to release the splice into air track section 104 to be moved into fixed track section 112. When the splice has cleared throat 114, diverter block 116 is withdrawn to permit the leading end of the next strip of web to be indexed by pinch roll assembly 42 further along guide tracks 68*a*, 68*b* of carriage assembly 22.

Builder Roll Assembly

Figure 9:
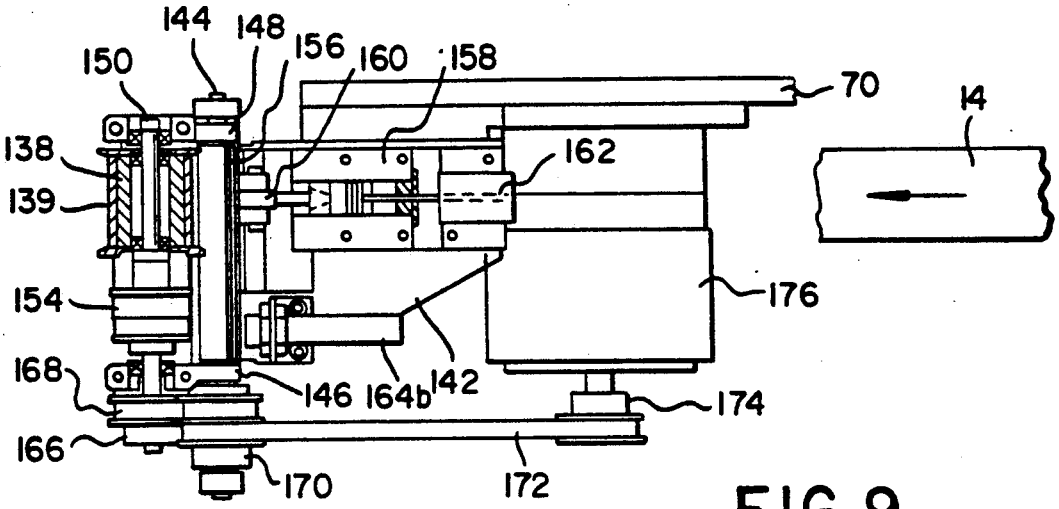
FIG. 9 shows a top view taken along line 9—9 of FIG. 8.
Figure 8:
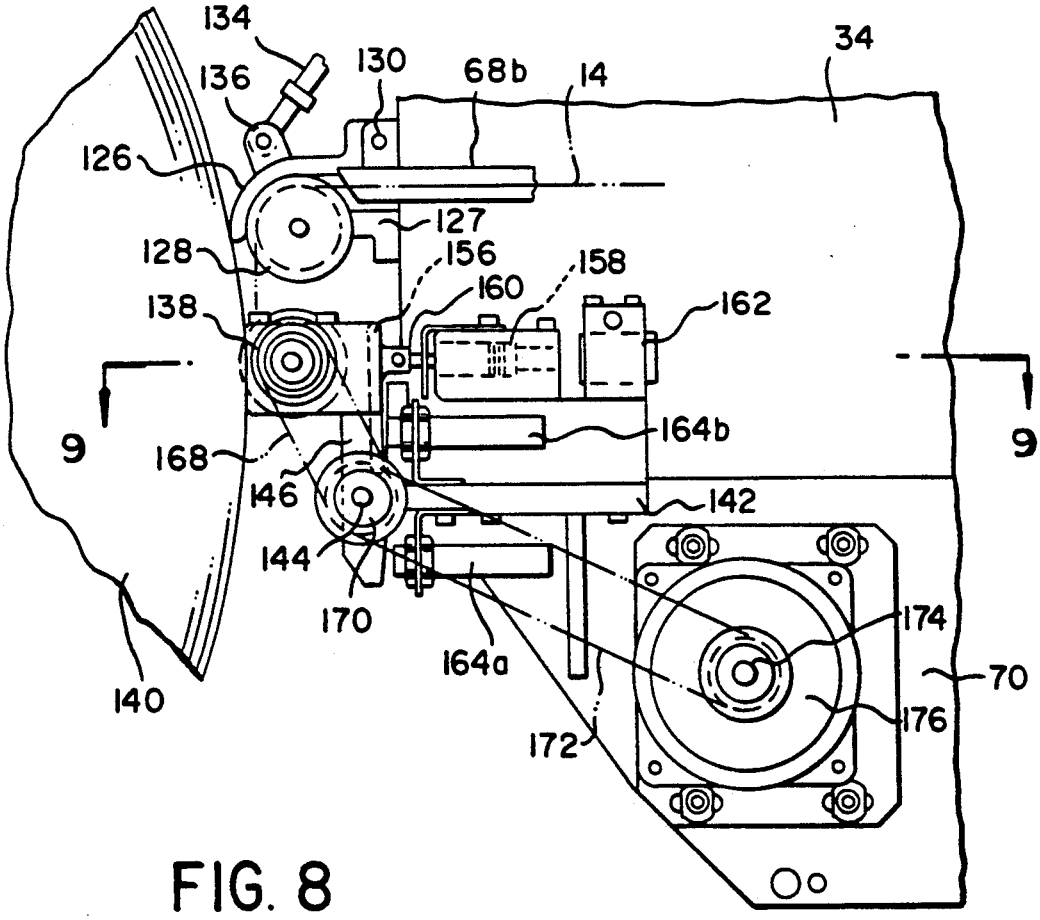
FIG. 8 shows an enlarged fragmentary front elevation view, partially broken away, of the builder roll assembly.

Referring to FIGS. 2, 8 and 9, web 14 passes from the outlet end of guide tracks 68*b* and, when the leading end of the web is to be attached to core 32, is deflected downward by a curved guide plate 126 and over a flanged idler roll 128. Guide plate 126 preferably is rotatably mounted on a pivot 130 to permit its being swung upward out of the way of the growing roll of web material and to prevent the tape tab on the trailing end of web 14 from sticking to the underside of the guide plate. For this purpose, an air cylinder 132 is pivotably mounted at its head end to back plate 34, the rod end 134 of the cylinder being mounted to guide plate 126 at a pivot 136.

From idler roll 128, web 14 passes over a portion of a flanged builder roll 138 which, in the case that web 14 is photographic film, preferably is provided with a urethane tire 139 which engages the full width of web 14 as it is wound onto roll 140. To prevent damage to photographic film, tire 139 preferably should have a hardness of about 60 Shore A. A bracket 142 on front plate 70 rotatably supports a transverse pivot shaft 144 at whose outer ends are mounted pivot arms 146, 148. As seen in FIG. 9, a shaft 150 is rotatably supported at the upper end of pivot arms 146, 148, builder roll 138 being mounted for rotation on shaft 150. An electrically actuated friction clutch 154 is coupled between shaft 150 and builder roll 138 so that rotation of shaft 150 will rotate builder roll 138 when clutch 154 is engaged. A transverse plate 156, shown in phantom in FIG. 8, joins the upper ends of pivot arms 146, 148 in front of an air cylinder 158 mounted on bracket 142. The rod end 160 of air cylinder 158 is pivotably connected to transverse plate 156; so that, pressure acting in air cylinder 158 will establish sufficient pressure between builder roll 138, web 14 and roll 140 to ensure good winding. As roll 140 grows, builder roll 138 will move toward air cylinder 158. A position sensor 162 is provided to monitor the position of the piston of air cylinder 158 and, hence, the movement of builder roll 138 as roll 140 grows. A signal corresponding to this position is provided to a conventional progammable controller, not illustrated, which then actuates stepping motor 26 to move rewind carriage assembly 22 away from roll 140 as the roll grows. Proximity switches 164*a*, 164*b* are provided to monitor the position of carriage assembly 22 relative to the circumference of roll 140 and to provide signals to the controller if the carnage assembly has moved too far and caused builder roll 138 to unload; or has not moved far enough and caused the builder roll to overload roll 140. A timing pulley 166 is mounted for rotation with shaft 150 and is connected via a timing belt 168 to a double timing pulley 170 rotatably mounted on transverse shaft 144. A further timing belt 172 connects timing pulley 170 to a timing pulley 174 rotatable with the output shaft of a stepping motor 176 mounted to front plate 70. The purpose of stepping motor 176 and the associated timing belts and pulleys will be discussed subsequently.

Tape Tab Cut and Apply Assemblies

Figure 12:
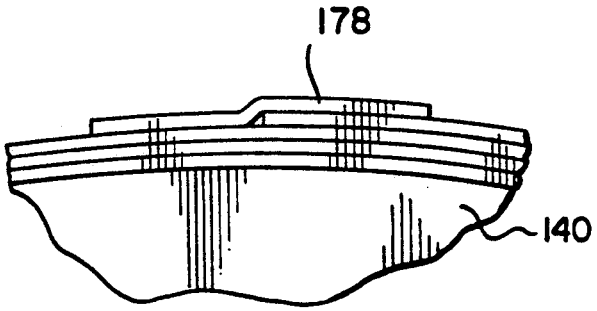
FIG. 12 shows an enlarged elevation view of another type of tape tab.
Figure 10:
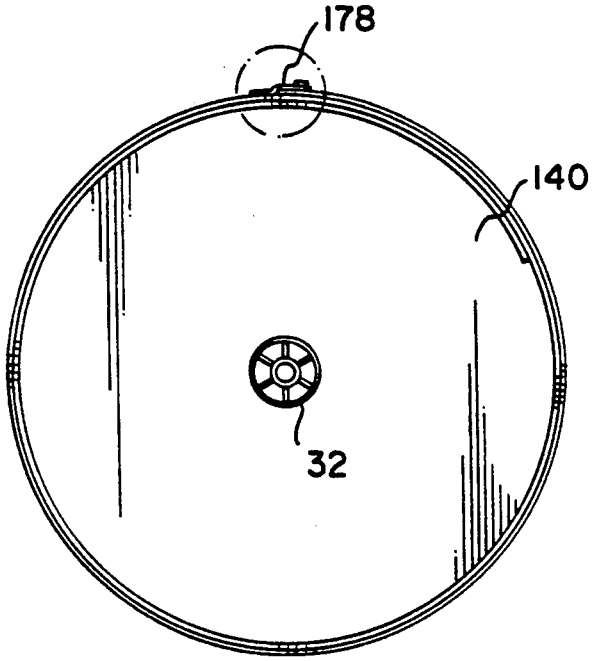
FIG. 10 shows an elevation view of a completed roll of web material, indicating the location of a tape tab which holds the outer convolution in place.

FIG. 10 illustrates schematically how the trailing end of web 14 is attached to the outermost convolution of roll 140 by a tape tab or strip 178 to secure the roll against unwinding. Tab 178 may be provided with an end fold 180 as shown enlarged in FIG. 11 to facilitate later removal of the tab, or may have plain ends as shown enlarged in FIG. 12. FIGS. 13 to 21 show the apparatus used to produce and apply such tabs to the trailing end of web 14. A bracket plate 182 for tape tab feed and cut assembly 28 is supported in front of face plate 12 by a lower bracket 184 and an upper bracket 186. An opening 188 is provided in bracket plate 182, to permit carriage assembly 22 to move back and forth in the manner previously described.

Figure 13:
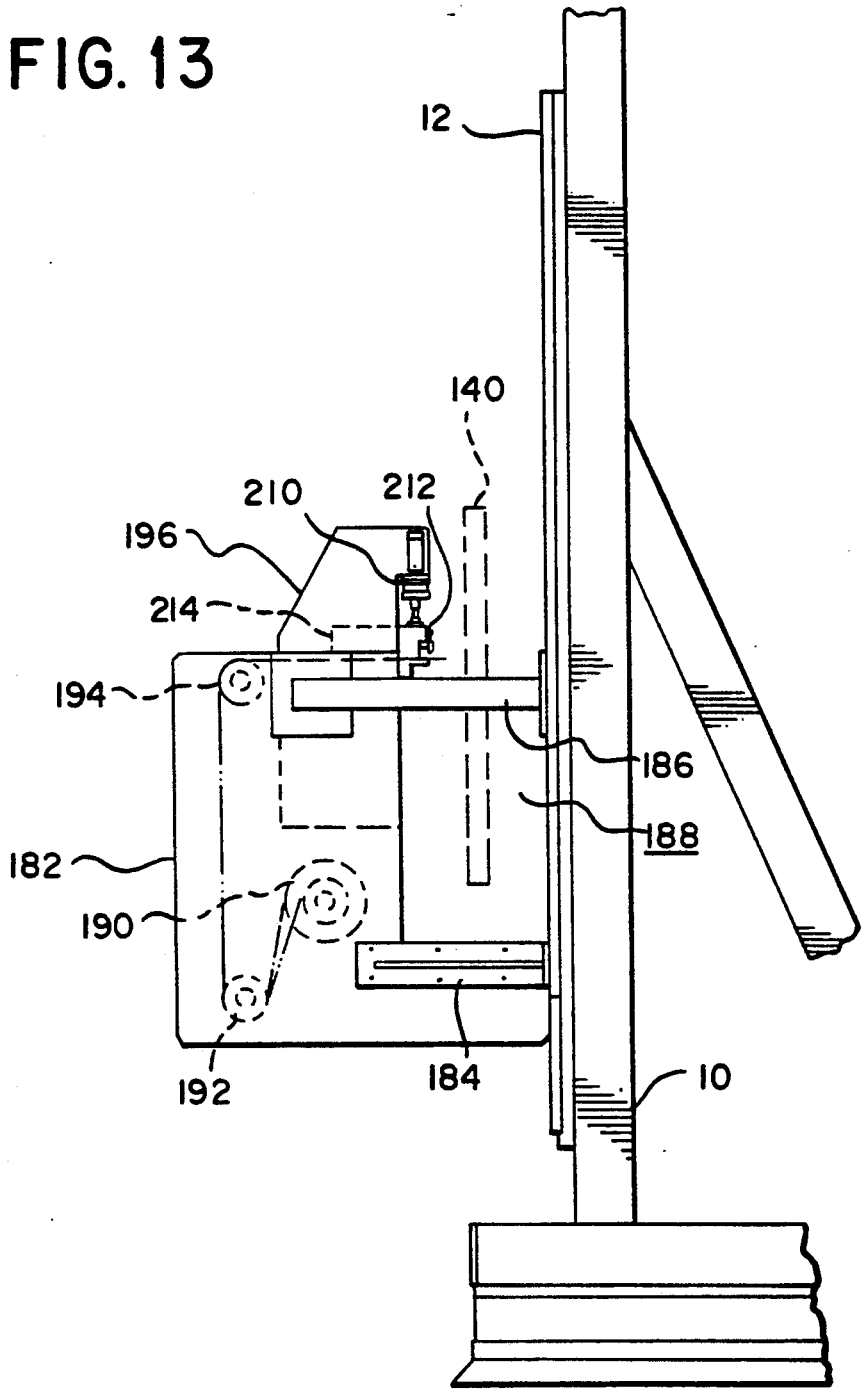
FIG. 13 shows a side elevation view of the apparatus of the invention, taken from the right as viewed in FIG. 1, but with the carriage assembly omitted.
Figure 14:
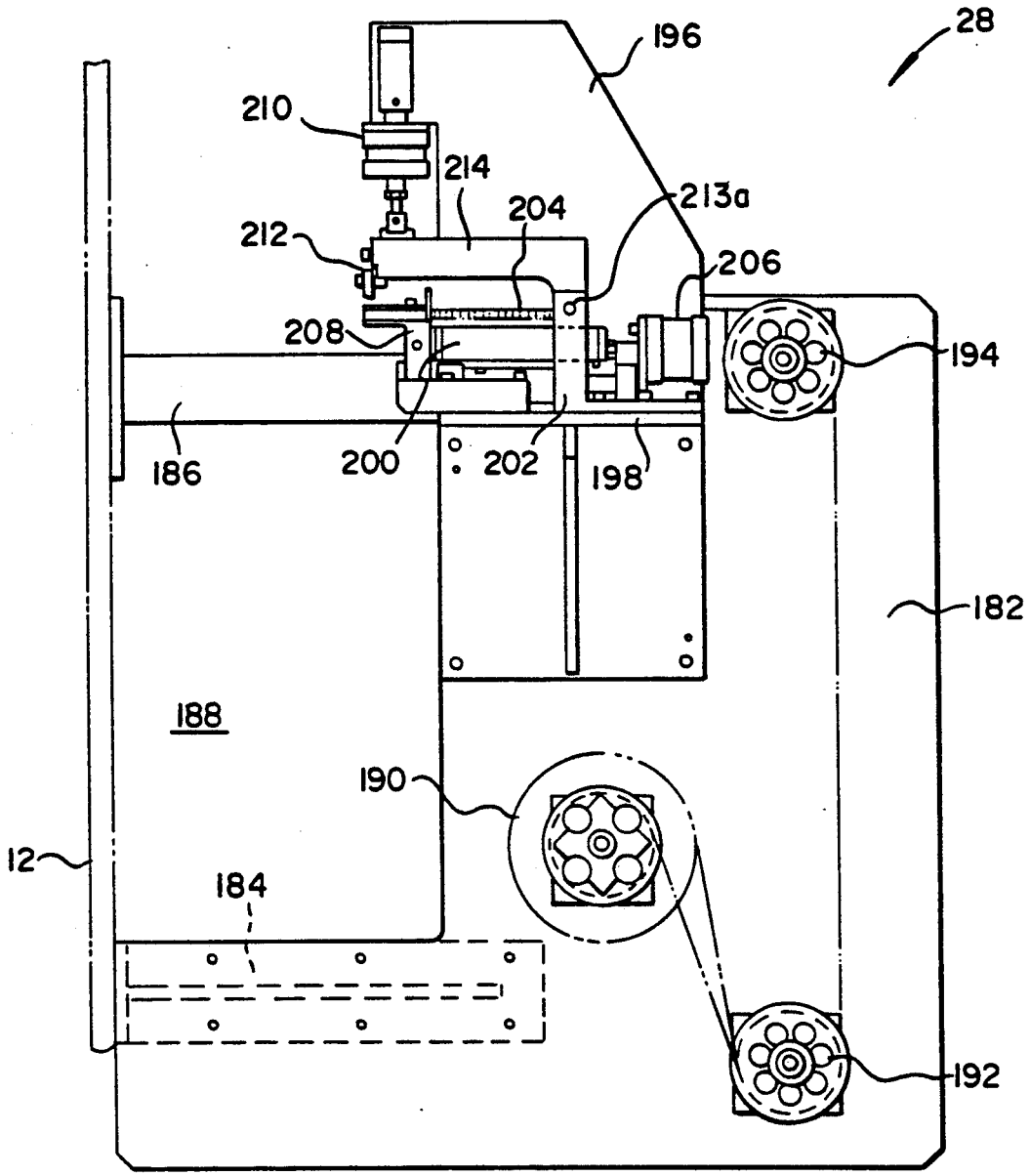
FIG. 14 shows a side elevation view of the tape tab feed and cut assembly, taken from the left as viewed in FIG. 1, also with the carriage assembly omitted.
Figure 15:
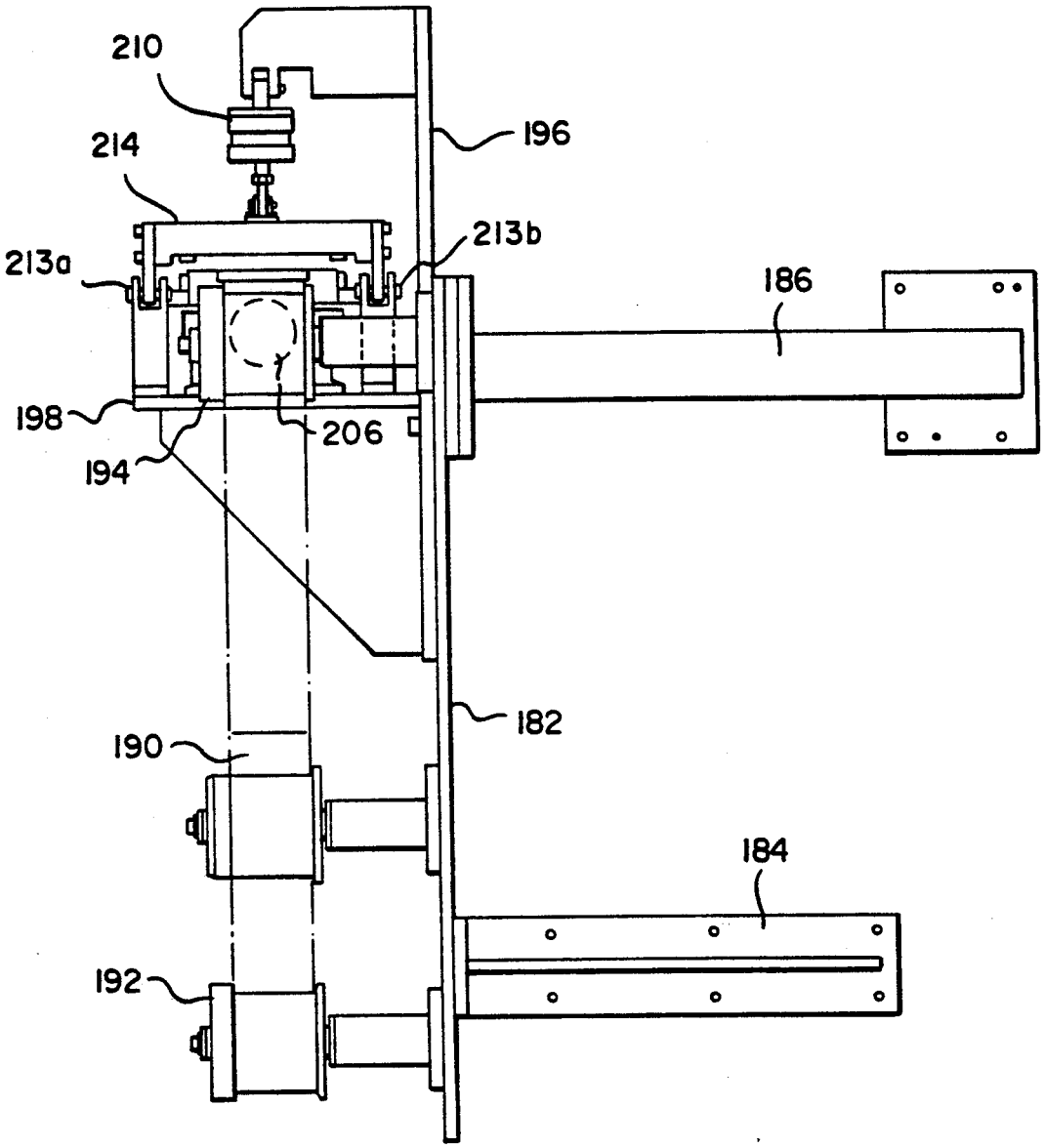
FIG. 15 shows a front elevation view of the assembly of FIG. 14.
Figure 18:
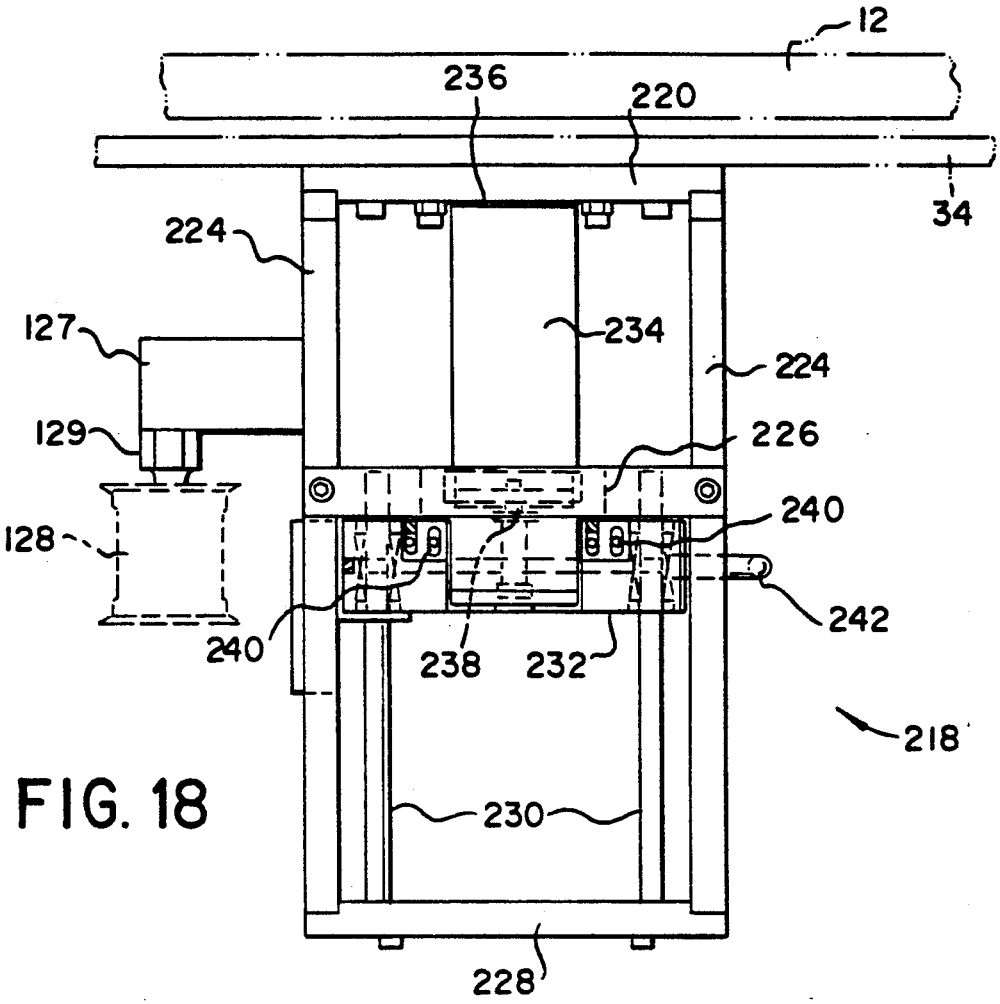
FIG. 18 shows a top view of the assembly of FIG. 17.
Figure 19:
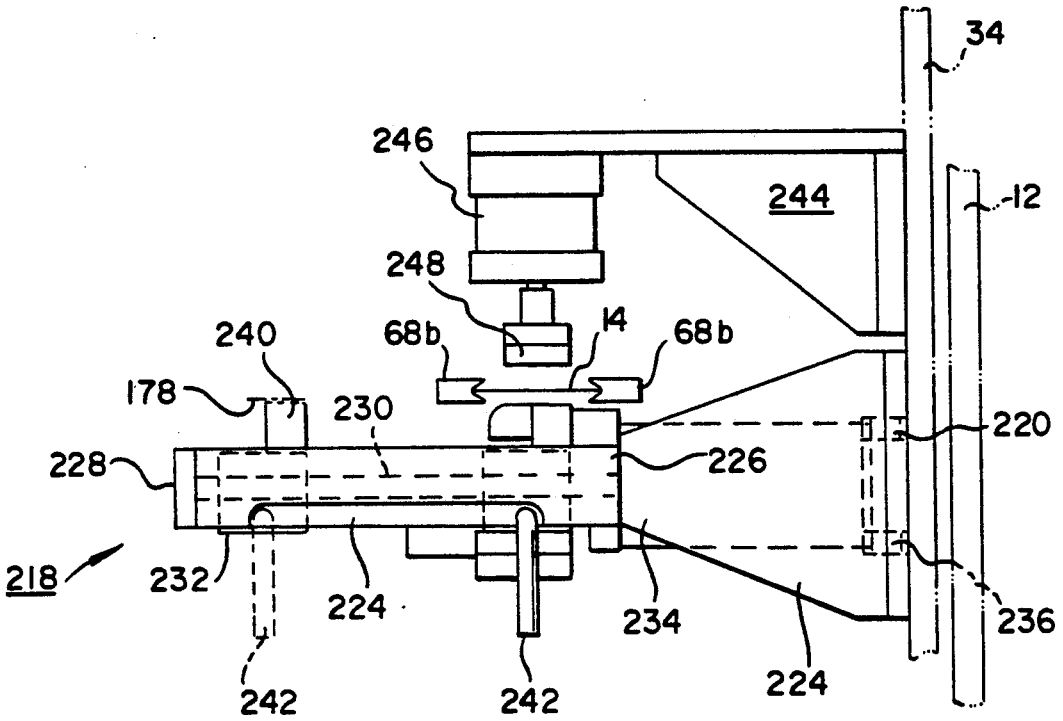
FIG. 19 shows a side elevation view of the tape applicator assembly, as viewed from the right of FIG. 17.

As shown in FIGS. 13 to 15, a tape stock roll 190 is mounted for rotation on bracket plate 182. In this embodiment, the width of the tape corresponds to the length of the tape tab 178 to be produced; that is, the tape is cut transversely to form each tape tab. From roll 190, the tape is drawn, during thread up of the apparatus, around an idler roll 192 with the sticky side facing away from roll 192 and then upward around a further idler roll 194. Near the upper edge of bracket plate 182, a further bracket plate 196 is mounted which supports a horizontal bracket plate 198. A shuttle 200 having a vacuum platen 204 on its upper surface is supported on plate 198 by suitable slides 202 which permit the shuttle to be moved by an air cylinder 206 toward and away from face plate 12. As viewed in FIG. 16, the tape is drawn sticky side up to the left and across vacuum platen 204, so that the lead end of the tape extends to the left beyond a fixed vacuum platen 208, coplanar with vacuum platen 204, by a distance equal to the desired width of tape tab 178. Vacuum platen 208 is then actuated to hold the tape securely for cutting and vacuum platen 204 is withdrawn to the right by a distance equal to the desired width of tape tab 178. At the same time, a pair of transversely spaced vacuum pads 240, to be discussed subsequently with regard to FIGS. 17 to 19, are moved beneath the leading end of the tape to hold tape tab 178 during and after cutting. Above vacuum platen 208, bracket plate 196 supports an air cylinder 210 whose rod supports a bracket plate 214 which is rotatably mounted to bracket plate 198 by pivots 213*a*, 213*b*. A knife holder 212 is mounted on the front or outer end of bracket plate 214 and supports a conventional rule die knife blade 216. Embedded in and coplanar with the surface of vacuum platen 208 is a flat steel bar 217. Actuation of air cylinder 210 pivots bracket plate 214 and drives blade 216 down sharply against bar 217 to cut tape tab 178.

Figure 16:
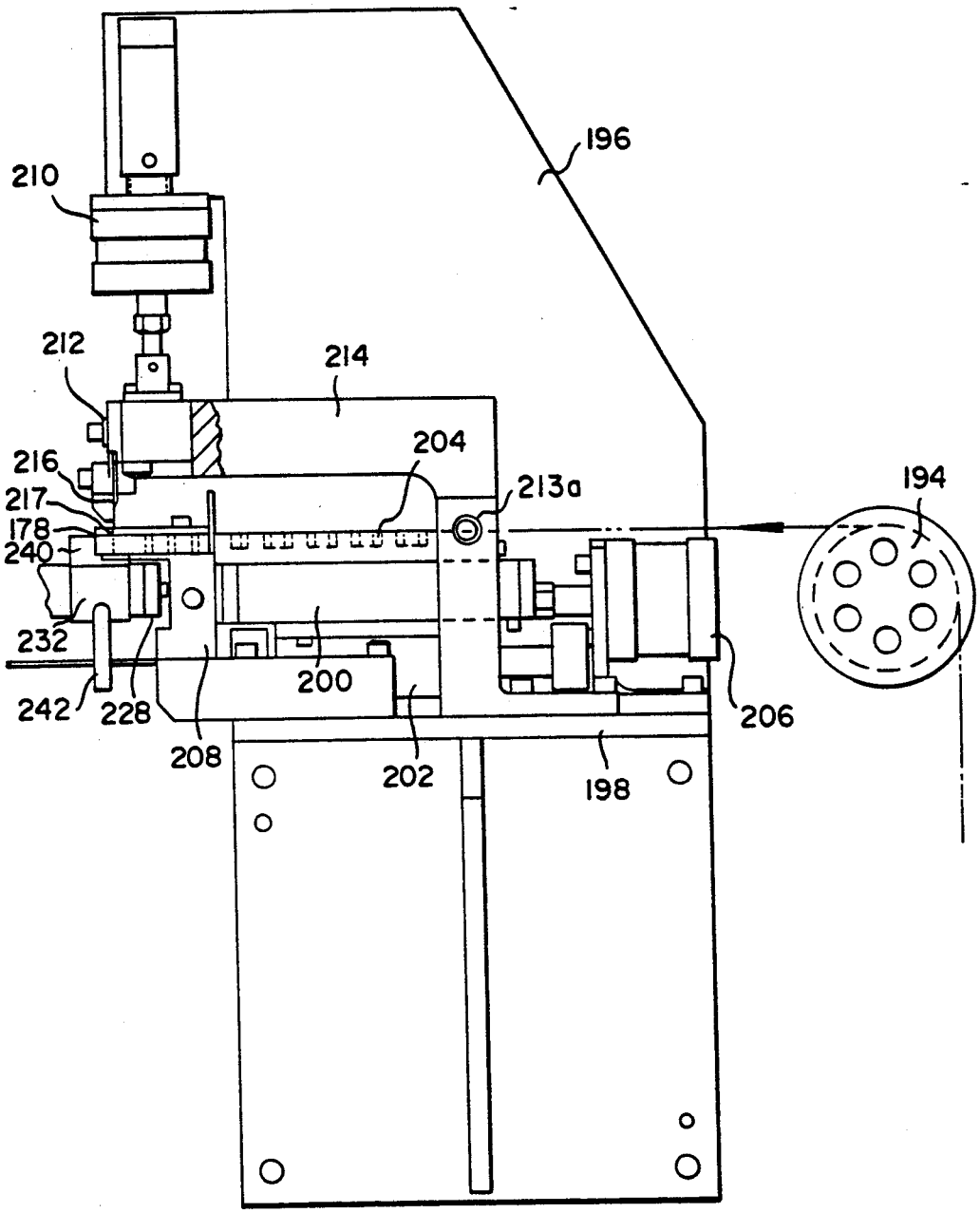
FIG. 16 shows an enlarged side elevation view of the tape shuttle and cut assembly shown in smaller scale in FIG. 14.
Figure 17:
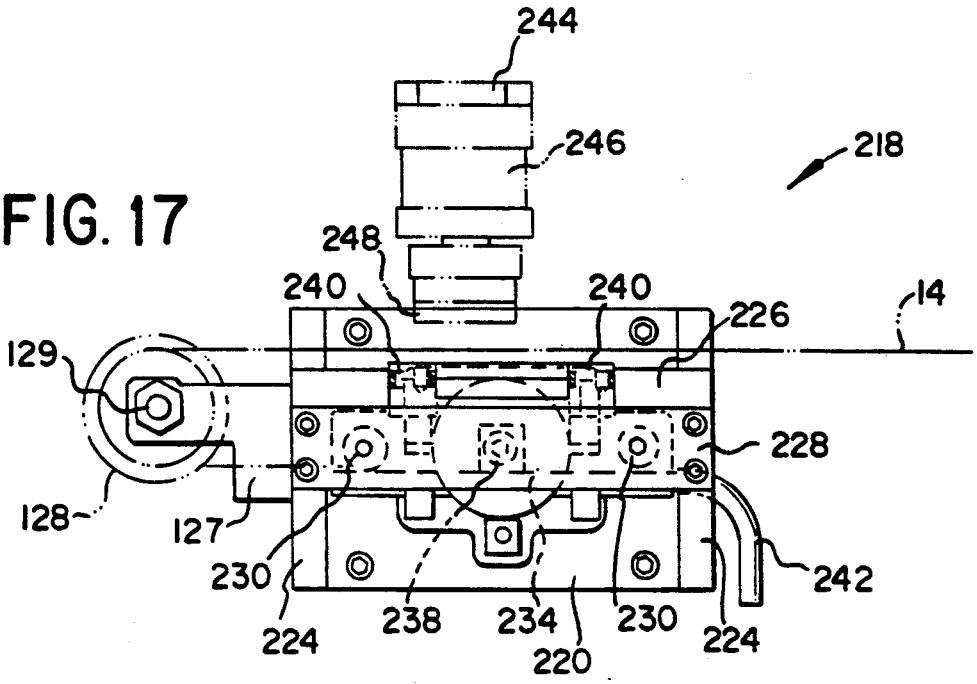
FIG. 17 shows a front elevation view of the tape applicator assembly.

In operation of the apparatus of FIGS. 13 to 16, the tape is threaded through the apparatus in the manner just described. Knife 216 is lowered to cut tape tab 178, after which vacuum pads 240 are withdrawn to the left with tape tab 178, to position the tape tab below the path of web 14 in guide tracks 68*b*. When the next tape tab is needed, vacuum platen 204 is actuated to grip the tape and then vacuum platen 208 is deactuated to release the leading end of the tape. Vacuum platen 204 is then moved to the left as seen in FIG. 16 until the new tape tab projects beyond vacuum platen 208 the required distance to be gripped by vacuum pads 240, which will have returned following application of the previous tape tab.

FIGS. 17 to 19 show the tape application assembly 218 which receives each tape tab and applies it to the trailing end of web 14. Assembly 218 is supported on back plate 34 by a bracket comprising a base plate 220, a pair of outwardly extending side plates 224, a central transverse plate 226 between side plates 224 and an end plate 228. A pair of slide rods 230 extend between central plate 226 and end plate 228 to support a shuttle carriage 232, which can be moved by an air cylinder 234 mounted at its head end to base plate 220 with its rod 238 extended through an opening in central plate 226 and connected to shuttle carriage 232. A pair of transversely spaced vacuum pads 240 are mounted on shuttle carriage 232 and connected to a vacuum line 242, to grip the ends of each tape tab 178 in the manner previously described. As shown most clearly in FIG. 19, shuttle carriage 232 can be moved by cylinder 234 from a position near end plate 228 where vacuum pads 240 pick up each tape tab 178, to a position near central plate 226 where the tape tab is positioned centrally below guide tracks 68*b* and web 14. Before application of the tape tab, the trailing end of web 14 is positioned centrally above vacuum pads 240 by coordinated rotation of core 32 and builder roll 138, in a manner to be described subsequently. To apply tape tab 178, a bracket 244 is attached to back plate 34 to support an air cylinder 246 whose rod supports a resilient tamping pad 248 on the side of web 14 opposite to vacuum pads 140 and tape tab 178. When cylinder 246 is actuated, pad 248 engages web 14 and deforms it downwardly into contact with the lead end of tape tab 178, without pulling the edges of web 14 out of the vee-shaped grooves in the guide tracks. Vacuum pads 140 are then deactuated and cylinder 246 is retracted, allowing the trailing end of web 14, with the lead end of tape tab 178 firmly applied sticky side up, to snap back between guide rails 68*b*.

Figure 11:
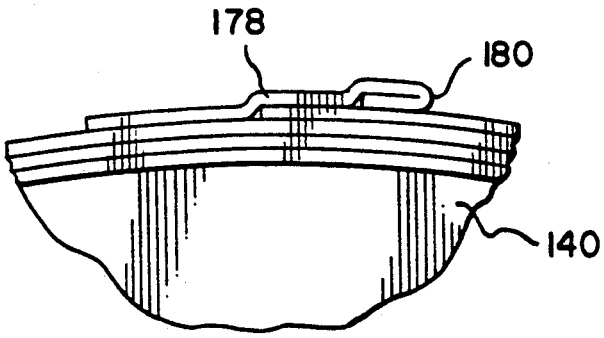
FIG. 11 shows an enlarged elevation view of one type of tape tab.
Figure 20:
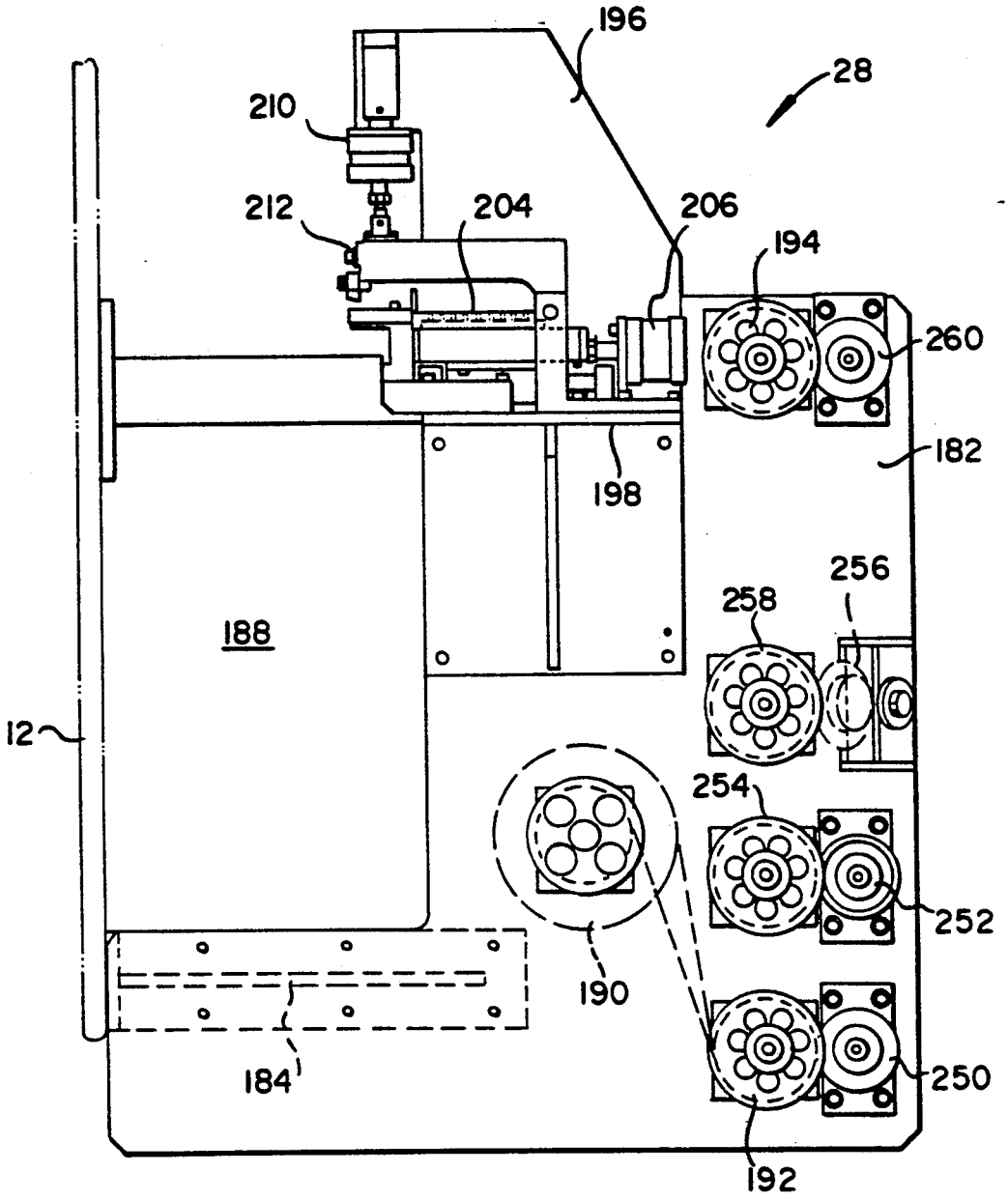
FIG. 20 shows an alternate version of the assembly of FIG. 14.
Figure 21:
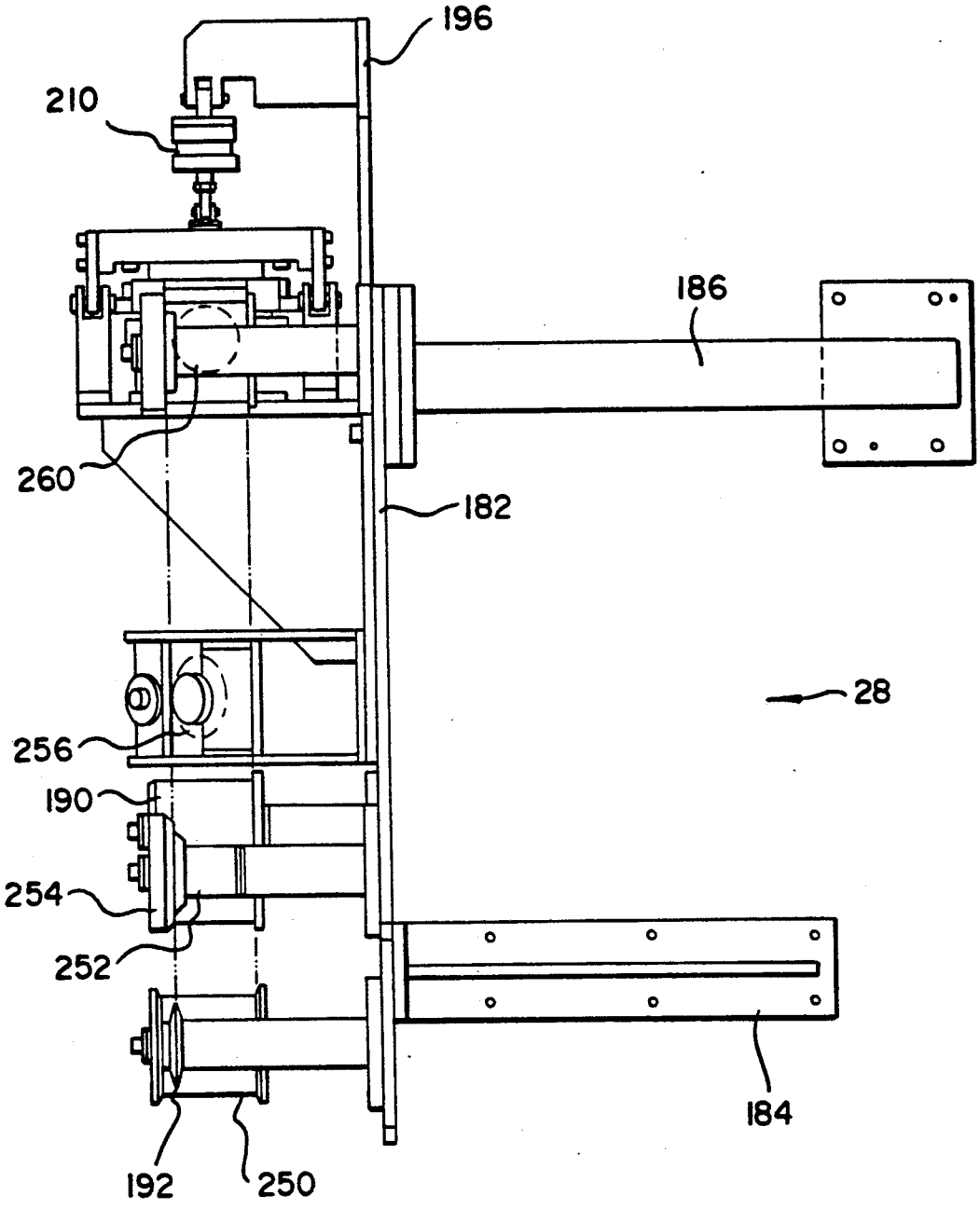
FIG. 21 shows a front elevation view of the assembly of FIG. 20.

FIGS. 20 and 21 illustrate an alternative version of tape tab feed and cut assembly 28 which can produce a tape tab with an end fold 180 as illustrated in FIG. 11. One edge of the tape is folded over on itself prior to cutting to form end fold 180 in the completed tape tab. A crease roll 250 cooperates with idler roll 192 to crease the tape parallel to one edge. A 45 degree fold roll 252 cooperates with an idler roll 254 to fold the same edge partially at the crease. A 90 degree fold roil 256 cooperates with an idler roll 258 to further fold the same edge. Finally, a 180 degree fold roll 260 folds the same edge over at the crease onto the rest of the tape to form end fold 180 before the tape reaches vacuum platen 204. Otherwise, the apparatus functions identically to that of FIGS. 13 to 16.

Cycle of Operation

At the beginning of the cycle of winding a new roll 140, a fresh core 32 will be placed on rewind spindle 30 and tape tab 178 will be present on vacuum pads 240 in the left hand position of FIG. 19. Carriage assembly 22 will be fully retracted to the right as shown in FIG. 1. Web 14 will be gripped by pinch roll assembly 42 with the lead end of the web at the cut line of knife assembly 76. When the roll winding sequence is started by the operator or the programmable controller, carriage assembly 22 moves all the way to the left as viewed in FIG. 1 and pinch roll assembly 42 is actuated to advance the lead end of web 14 through guide tracks 68*a*, 68*b*, beneath curved guide 126 and over builder roller 138 to permit attachment of the lead end to core 32 by any convenient means. Once web 14 has been properly attached to core 32, rewind spindle 30 begins to rotate and pull web 14 through the apparatus. Guide 126 is pivoted out of the way. One way clutch 48 allows pinch roll 54 to overrun the speed of stepping motor 44 as the web speed increases. Eventually, the pinch roll is moved out of engagement by air cylinder 64 and the entire apparatus accelerates to normal winding speed. As roll 140 builds, the increasing diameter is sensed by position sensor 162 and carriage assembly 22 is withdrawn to the right at a corresponding rate.

When roll 140 is nearly completed, as determined by sensing footage, by measuring roll diameter, by detecting the arrival of a splice or by any other convenient means, spindle 30 is slowed to a stop by its drive motor, not illustrated, but the motor is not turned off. Thus, torque is maintained on the spindle as necessary to maintain the tension placed on web 14 by dancer assembly 18. If a splice is present, web 14 will be stopped just before the splice reaches pinch roll assembly 14. At this point, clutch 154 is actuated to operatively connect builder roll 138 to stepping motor 176; and cylinder 64 is actuated to reengage pinch roll 54 with web 14. Stepping motors 44 and 176 are locked in position and builder roll 138 continues to be loaded against roll 140 by cylinder 158, with the winding motor still maintaining some torque but being stalled by the tension in web 14.

Cutoff knife assembly 76 is then operated to cut web 14 after which wound roll 140 is held back by the counter torque of stepping motor 176 which acts against the torque on spindle 30. Stepping motor 176 is then actuated to advance web 14 and move the trailing end into position above the midpoint of tape tab 178 held on vacuum pads 240. Air cylinder 246 is then actuated to bring tamper pad 248 down and to deflect the trailing end of web 14 downward into contact with tape tab 178. Tamper pad 248 is then withdrawn, thereby permitting web 14 to return to its former position between guide tracks 68*b*. Stepping motor 176 is then actuated to advance web 14 and tape tab 178 and thereby move the trailing end and tape tab 178 out of guide tracks 68*b* and between builder roll 138 and roll 140 where the pressure exerted on builder roll 138 by air cylinder 158 causes the trailing end of tape tab 178 to adhere firmly to the underlying convolution of roll 140. During both of these movements of web 14 following operation of cutoff knife assembly 76, the motor for spindle 30 supplies the torque to rotate roll 140, while stepping motor 176 provides a retarding torque while allowing roll 140 to rotate. Thus, the full winding tension is maintained in the outer convolution on roll 140 until tape tab 178 has been firmly adhered by builder roll 138.

Once tape tab 178 has been rolled into place on roll 140, the motor for spindle 30 is turned off, clutch 154 is released and carriage assembly 22 is retracted to the right, as viewed in FIG. 1. The finished roll 140 is then removed from spindle 30 and a fresh core 32 is placed on the spindle. At the same time, a fresh tape tab 178 is cut, placed on vacuum pads 240 and moved beneath tamper pad 248 for application to the succeeding strip of web 14, in the manner previously described. If a splice is present in web 14, at the same time the next tape tab is being prepared, the splice will be cut from the web and removed on air track 104, 108, 112, in the manner previously described.

The invention has the primary advantage of providing consistently wound, tightly taped rolls of web 14 whose outer convolutions are not subject to loosening that can cause abrasion of the web during transport. In addition, the very tightly wound rolls are more suitable for automated removal from winding spindle 30.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. Apparatus for winding web material onto a spool, said apparatus comprising:

a source of web material to be wound;

a first frame;

means mounted on said first frame for rotating said spool about an axis to wind said web material onto said spool;

a second frame;

means mounted on said first frame for permitting said second frame to move toward or away from said axis;

roll means mounted on said second frame for engaging an outermost convolution of said web material during winding onto said spool;

means mounted on said first frame for moving said second frame on said means for permitting toward said axis to facilitate attachment of said leading end to said spool and away from said axis to allow continued winding of said web material onto said spool;

means mounted on said second frame for pressing said roll means against said outermost convolution as a trailing end of said web material nears said spool;

means for stopping said spool while maintaining torque thereon;

means mounted on said second frame for applying a tab of adhesive tape to a trailing end of said web material before said trailing end passes said roll means, said tab of adhesive tape having an adhesive portion extended beyond said trailing end, whereby said adhesive portion of said tab of adhesive tape is rolled by said roll means onto an underlying convolution of said web material to secure said trailing end; and motor means for controllably rotating said roll means in contact with said outermost convolution and said tab of adhesive tape as said spool is rotated, in order to maintain tension in said web material as said tab of adhesive tape is applied to said underlying convolution.

2. Apparatus according to claim 1, further comprising:

means mounted on said second frame for permitting said roll means to move away from said axis;

means for detecting the position of said roll means relative to said second frame as said web material is wound onto said spool; and means responsive to said means for detecting for actuating said means for moving to move said second frame away from said axis as said web material is wound.

3. Apparatus according to claim 1, further comprising:

means mounted on said second frame for guiding a leading end of said web material toward said spool; and pinch roll means mounted on said second frame for driving said web material through said means for guiding.

4. Apparatus according to claim 3, wherein said pinch roll means comprises a first, idler roll; a second, pinch roll; means for controllably rotating said pinch roll; and means for moving said pinch roll into or out of contact with said web material opposite said idler roll.

5. Apparatus according to claim 4, wherein said source of web material comprises means for maintaining a predetermined tension in said web material upstream of said pinch roll.

6. Apparatus according to claim 1, wherein said web material comprises a series of strips of web material joined end to end by splices, further comprising:

means for cutting said web material downstream of each of said splices before each of said splices reaches said means for applying, thereby defining said trailing end for a leading strip of said web material and thereafter for cutting said web material upstream of each of said splices, thereby defining said leading end for a following strip of said web material;

means for deflecting each of said splices from said means for guiding; and means for conveying each of said splices away from said means for guiding after said splices have been cut from said web material.

7. Apparatus according to claim 6, further comprising:

pinch roll means, mounted on said second frame upstream of said means cutting, for driving said web material through said means for guiding.

8. Apparatus according to claim 7, wherein said pinch roll means comprises a first, idler roll; a second, pinch roll; means for controllably rotating said pinch roll; and means for moving said pinch roll into or out of contact with said web material opposite said idler roll.

9. Apparatus according to claim 1, wherein said means for applying comprises:

a source of adhesive tape, said tape having a leading end;

means for cutting said adhesive tape into tabs;

means for grasping said leading end of said adhesive tape and advancing said leading end to said means for cutting;

means for acquiring and moving each of said tabs for adhesive tape to a position opposite said trailing end and adjacent said means for guiding; and means for moving said trailing end and one of said tabs of adhesive tape into engagement.

10. Apparatus according to claim 9, wherein said means for guiding comprises a pair of spaced, elongated guide tracks each having a groove for receiving an edge of said web material; and said means for moving presses against said trailing end to bow said trailing end into contact with said tabs of adhesive tape on said means for acquiring and moving.

11. Apparatus according to claim 9, further comprising means for folding over an edge of said adhesive tape upstream of said means for cutting into tabs, whereby an end fold is formed at one end of each of said tabs of adhesive tape.

12. A method for winding web material onto a spool, said method comprising the steps of:

rotating said spool about an axis to wind said web material onto said spool;

engaging an outermost convolution of said web material with a roll during winding onto said spool;

pressing said roll against said outermost convolution as a trailing end of said web material nears said spool;

stopping said spool while maintaining torque thereon;

applying torque to said roll to maintain tension on said outermost convolution;

applying a tab of adhesive tape to said trailing end before said trailing end passes said roll, said tab of adhesive tape having an adhesive portion extending beyond said trailing end; and rotating said spool and said roll to maintain tension in said web material, whereby said adhesive portion of said tab of adhesive tape is applied by said roll to an underlying convolution of said web material to secure said trailing end and to maintain tension in said web material.

13. Apparatus for winding web material onto a spool, said apparatus comprising:

a source of web material to be wound;

a first frame;

means mounted on said first frame for rotating said spool about an axis to wind said web material onto said spool;

a second frame;

means mounted on said first frame for permitting said second frame to move toward or away from said axis;

roll means mounted on said second frame for engaging an outermost convolution of said web material during winding onto said spool;

means mounted on said first frame for moving said second frame on said means for permitting toward said axis to allow initial contact of said roll means with said outermost convolution and away from said axis to allow continued winding of said web material onto said spool;

means for permitting said roll means to move away from said axis relative to said second frame;

means for detecting the position of said roll means relative to said second frame as said web material is wound onto said spool;

means responsive to said means for detecting for actuating said means for moving to move said second frame away from said axis as said web material is wound; and means mounted on said second frame for pressing said roll means against said outermost convolution during winding.

14. Apparatus according to claim 13, further comprising motor means for controllably rotating said roll means in contact with said outermost convolution.

15. Apparatus according to claim 13, further comprising:

means mounted on said second frame for guiding a leading end of said web material toward said spool; and pinch roll means mounted on said second frame for driving said web material through said means for guiding.

16. Apparatus according to claim 15, wherein said pinch roll means comprises a first, idler roll; a second, pinch roll; means for controllably rotating said pinch roll; and means for moving said pinch roll into or out of contact with said web material opposite said idler roll.

17. Apparatus according to claim 16, wherein said source of web material comprises means for maintaining a predetermined tension in said web material upstream of said pinch roll.

* * * * *